US005598893A

United States Patent [19]

Carlson

[11] Patent Number: 5,598,893

[45] Date of Patent: Feb. 4, 1997

[54] SYSTEM AND METHOD FOR SETTING UP SKI COURSE GATES

[76] Inventor: Thomas G. Carlson, 8955 138th Street Ct., Apple Valley, Minn. 55124

[21] Appl. No.: 611,711

[22] Filed: Mar. 6, 1996

Related U.S. Application Data

[63] Continuation-in-part of Ser. No. 411,310, Mar. 28, 1995, abandoned.

[51] Int. Cl.[6] ..... B23B 47/02; E21B 3/00

[52] U.S. Cl. ..... 173/216; 173/217

[58] Field of Search ..... 173/216, 217, 173/29; 81/57.3; 408/124

[56] References Cited

U.S. PATENT DOCUMENTS

| | | | |
|---|---|---|---|
| 2,975,848 | 3/1961 | Roberts | 173/216 |
| 3,032,126 | 5/1962 | Rexine | 173/217 X |
| 3,177,736 | 4/1965 | Kilmartin et al. | 74/417 |
| 3,257,877 | 6/1966 | Ulrich et al. | 173/216 X |
| 3,316,983 | 5/1967 | Goodman | 173/216 |
| 3,367,426 | 2/1968 | Laverty | 173/217 X |
| 3,429,386 | 2/1969 | Secrist et al. | 173/217 |
| 3,490,547 | 1/1970 | Stewart | 173/217 X |
| 3,720,270 | 3/1973 | Pasquale | 173/217 |
| 3,961,671 | 6/1976 | Adams et al. | 173/1 |
| 4,382,730 | 5/1983 | Reinisch | 173/217 X |
| 4,493,223 | 1/1985 | Kishi et al. | 173/217 X |
| 4,735,119 | 4/1988 | Riley | 81/57.3 |
| 4,949,463 | 8/1990 | Chen | 30/500 |
| 5,033,552 | 7/1991 | Hu | 173/217 |
| 5,350,027 | 9/1994 | Mauch et al. | 173/216 |
| 5,427,002 | 6/1995 | Edman | 173/217 X |

*Primary Examiner*—Joseph J. Hail, III
*Assistant Examiner*—Jay A. Stelacone
*Attorney, Agent, or Firm*—Merchant & Gould

[57] ABSTRACT

The present disclosure relates to a method for driving a ski course gate into a snow covered surface. The method includes the step of providing a portable driver having a housing, a drive member rotatedly connected to the housing, a gate engaging structure connected to the drive member, a rotational power source, and a rotational transference assembly mounted within the housing for transferring a rotational input from the rotational power source to the drive member. The method also includes the steps of inserting a pole portion of the ski course gate within a longitudinal channel of the drive member and sliding the pole portion longitudinally through the longitudinal channel of the drive member. Next, a torque transmitting engagement is formed between the gate engaging structure of the portable driving device and an auger portion of the ski course gate. Finally, the rotational power source is activated while a downward force is applied to the ski course gate such that the auger portion of the ski course gate is rotationally driven into the snow covered surface.

9 Claims, 4 Drawing Sheets

SYSTEM AND METHOD FOR SETTING UP SKI COURSE GATES

CROSS REFERENCE TO PARENT APPLICATION

This application is a continuation-in-part of U.S. patent application Ser. No. 08/411,310 which was filed on Mar. 28, 1995 now abandoned.

TECHNICAL FIELD

Generally, the present invention relates to devices for transferring torque. More specifically, the present invention relates to devices for driving ski course gates into the snow.

BACKGROUND OF THE INVENTION

There is a need to quickly drive course gates into the snow on a ski slope to define a course. In a ski practice situation, a course is typically set and a large number of runs are made through the course. With each run, the condition of the course deteriorates. Ultimately, during the practice session, a new course must be set in order to provide suitable practice for the skiers. Over the period of a several hour practice session, the ski course will necessarily be reset several times. Resetting the ski course is a time consuming task that subtracts from the valuable practice time allocated on busy slopes.

The gates are typically poles formed of thermoplastic material that project upward from the surface of the snow approximately four feet. The gate poles are made of a flexible thermoplastic material, having a hollow core and are approximately an inch and one-quarter in outside diameter. The poles are designed to deflect when struck by a passing skier and to return to the undeflected configuration after being passed by the skier.

The gates typically have an auger section connected to the bottom of the pole. The auger section has a spiral flight defined thereon. Above the spiral flight, are driving teeth designed to be engaged by a driver for turning the spiral flight into the snow. There are presently several makes of gate and each such different make has driving teeth of a unique configuration requiring a driver that is uniquely adapted to the driving teeth.

The current practice in setting course gates is for a first person to bore a hole in the snow. This is usually done with a power borer. The hole in the snow is typically somewhat smaller in diameter that the auger section of the gate pole, in order that the auger might establish a firm bite in the hole. A second person follows the first and drives the gate into the hole formed by the first person. This is done by a lever bar that has a central bore formed therein. The bore is slipped over the top of the gate pole and slid down to engage the driving teeth formed at the top of the auger section. The second person then manually turns the auger section into the hole. After the gate is in place, the lever bar is slid off the top of the gate pole. The lever bar is unique to the specific make of gate pole being used so that the notches formed in the central bore of the lever bar engage the driving teeth of the gate pole.

There is a need in the industry to be able to rapidly set course gates to define a course. This is desirable in order to maximize the skiing time during any fixed practice session. Additionally, the course gate driving operation should be able to be accomplished by a single person. The gate driver utilized should have the flexibility to be able to be used with all the various makes of course gates. And finally, the gate driver should be powered in order to minimize the driving time and effort required to set the gate.

A number of powered borers are known. None have structure or teach structure that is adapted to driving gate poles. The first such borer is as disclosed in U.S. Pat. No. 2,975,848 to Roberts and is designed to bore holes for the placement of poles. The auger is an integral component of the borer.

An extension to a drill machine table is disclosed in the U.S. Pat. No. 5,350,027 to Mauch et al. The Mauch et al borer is an extension to an existing drill table that extends the distance from the table that a hole can be bored. The purpose is to allow the boring of a hole very close to a building without requiring that the drill table be positioned close to the building. A drill is attached to driven shaft by a coupling. The driven shaft is integral to the drill machine table extension.

An earth auger is disclosed in U.S. Pat. No. 3,177,736 to D. G. Kilmartin et al. The Kilmartin Auger is a large device having a T shaped frame for resisting the reaction forces generated by rotation of the auger that must be operated by two persons. The auger is integral to the earth auger device.

An anchor driver is disclosed in U.S. Pat. No. 3,961,671 to Adams et al. The Adams driver is utilized to drive anchors into the ground. After such driving, the anchor is left in the ground. The driver is designed to engage the end of the rod that comprises a portion of the anchor by being in threaded engagement therewith. The anchor is left in place in the earth by disengaging the threads at the end of the rod from the driver.

SUMMARY OF THE INVENTION

The gate driver of the present invention substantially meets the aforementioned needs. The gate driver is preferably powered by a commercially available battery powered hand drill. The hand drill acts through a rotational transference assembly to drive the auger of a ski course gate into the snow. No preparatory hole is to be bored into the snow. The gate driver is readily operated by a single person and easily transportable from gate to gate for the setting thereof. The gate driver preferably has a replaceable gate engaging structure such as a keyway, bit or other tool that is adapted for forming a torque transferring engagement with the auger of the course gate. Gate engaging structures of various sizes and configurations can be used depending upon the particular make of course gate desired to be driven.

The present invention further relates to a portable driving device including a drive member rotatable about a longitudinal axis. The drive member defines a longitudinal channel configured to receive a pole portion of a ski course gate. In a preferred embodiment, the drive member has an open side configured to facilitate inserting the pole portion of the gate into the longitudinal channel. A gate engaging structure is connected to the drive member and is adapted to form a torque transferring engagement with an auger portion of the gate. A rotational transference assembly is operably connected to the drive member. The rotational transference assembly is adapted to transfer a rotational input from a rotational power source to the drive member causing the drive member to rotate about the longitudinal axis.

The open sided configuration of the preferred embodiment makes the device significantly easier to use than conventionally known gate driving devices. Conventionally known devices are typically slipped over the top of the pole a ski course gate. Because gate poles are usually five to six feet tall, it is awkward to slip a driving device over the top of a pole. Furthermore, gate poles often have flags attached to their tops that must be removed before a conventional driving device can be used. The open sided configuration of the preferred embodiment avoids these problems because it does not need to be slipped over the top of a ski course gate. Instead, the driving device is configured to laterally receive the ski pole of a ski course gate thereby allowing the device to be quickly and easily coupled with the auger portion of the gate.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Figure 1:
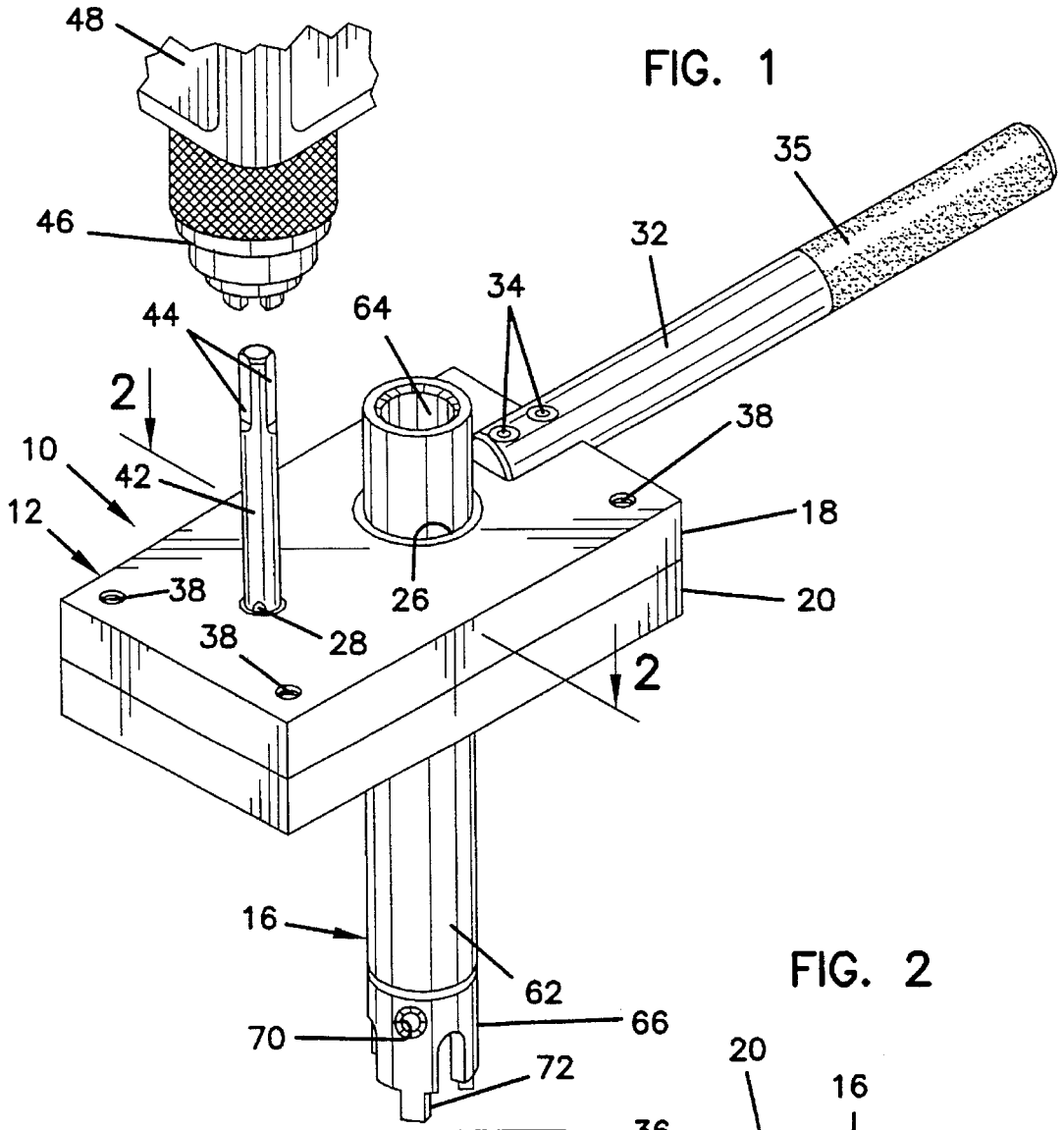
FIG. 1 is a perspective view of a gate driver of the present invention.
Figure 2:
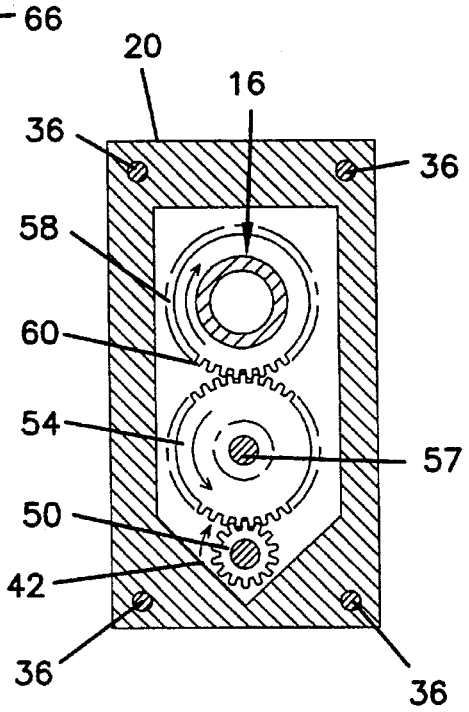
FIG. 2 is a sectional view taken along the section line 2—2 of FIG. 1, depicting the reduction gears.
Figure 3:
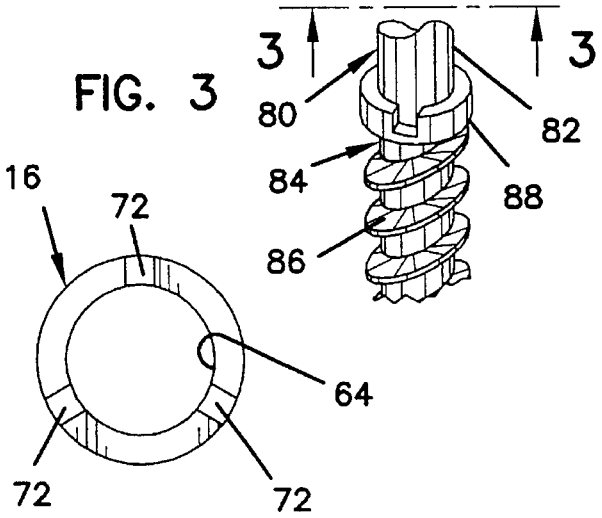
FIG. 3 is a sectional view taken along the section line 3—3 of FIG. 2, depicting the auger engaging teeth of the replaceable bit.
Figure 4:
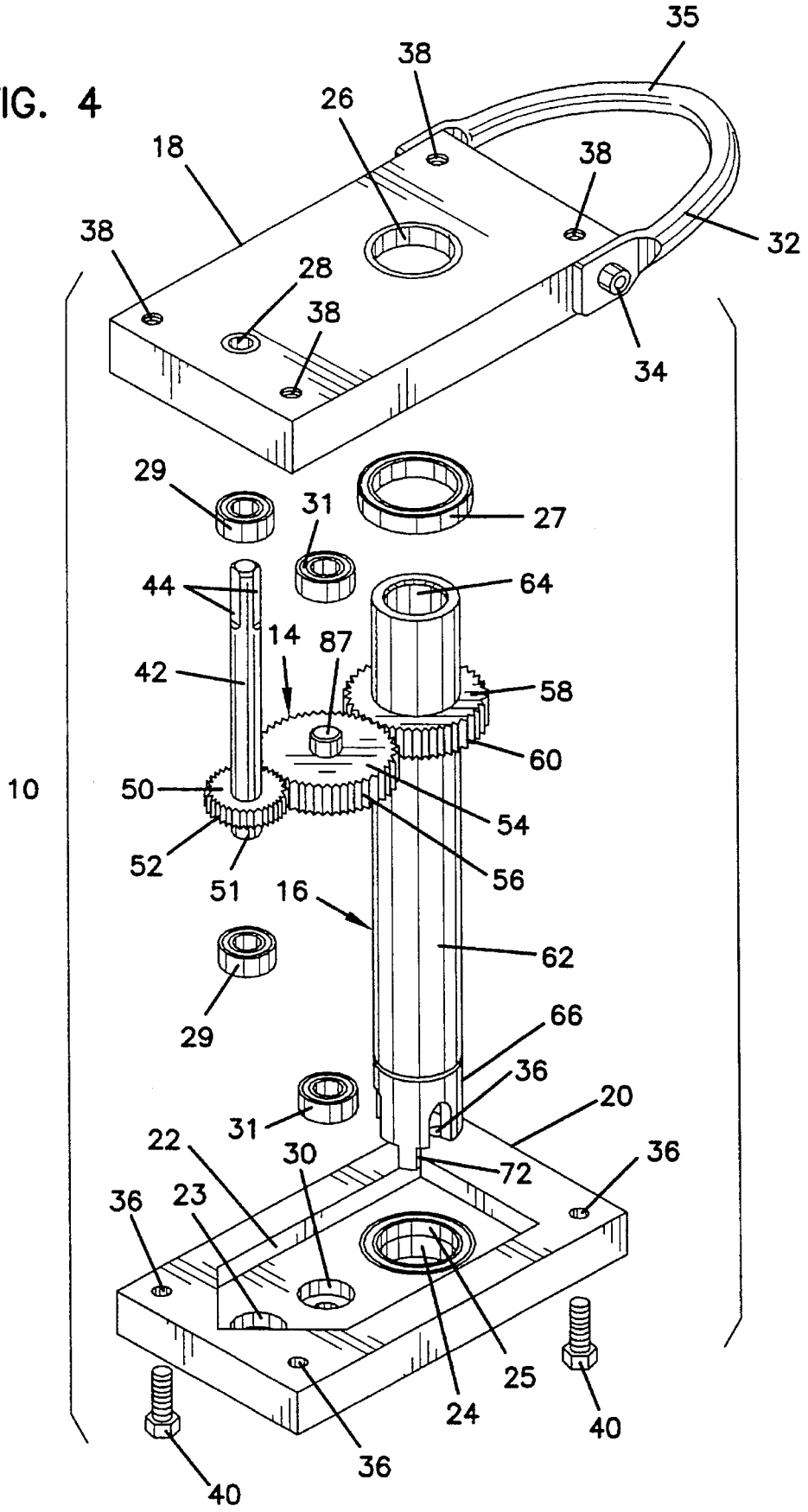
FIG. 4 is an exploded perspective view of the gate driver of FIG. 1.

The gate drive of the present invention is shown generally at 10 in FIGS. 1 and 4. The gate drive 10 has three major subcomponents: gear case 12, gear set 14, and gate chuck 16.

The gear case 12 has two major subcomponents: upper gear case 18 and lower gear case 20. The upper gear case 18 and the lower gear case 20 are preferably formed from solid aluminum barstock. The barstock utilized to form the upper gear case 18 and the lower gear case 20 are preferably of the same size, being approximately nine inches in length, four inches in width, and three-eighths of an inch in height. Mirror image gear housings 22 are formed in the upper gear case 18 and the lower gear case 20.

A lower chuck bore 24 is formed in the lower gear case 20 and is in registry with a similar upper chuck bore 26 formed in the upper gear case 18. A needle bearing 25 is disposed within the lower chuck bore 24 and a needle bearing 27 is disposed within upper chuck bore 26.

A drive shaft bore 28 is formed in the upper gear case 18. A needle bearing 29 is disposed within the drive shaft bore 28. A cup-shaped input gear bearing holder 23 is formed in the lower gear case 20. The open end of the input gear bearing holder 23 opens into the gear housing 22 formed therein. A needle bearing 29 is disposed within the input gear bearing holder 23.

A cup-shaped spur gear bearing holder 30 is formed in the lower gear case 20. The open end of the spur gear bearing holder 30 opens into the gear housing 22 formed therein. A needle bearing 31 is disposed within the spur gear bearing holder 30. A similar spur gear bearing holder (not shown) and needle bearing (not shown) are formed opposed to the spur gear bearing holder 30 in the upper gear case 18.

An elongate handle 32 is affixed to the upper gear case 18 by bolt 34 is depicted in FIG. 1. The handle 32 has a generally oval-shaped cross sectional gripping portion 35. It is understood that the handle 32 could as well be another convenient gripping shape, as for example, semicircular in shape, as depicted in FIG. 4.

In assembly, the upper gear case 18 and the lower gear case 20 are brought into registry. A plurality of cap screw bores 36 formed in lower gear case 20 and arrayed around the perimeter thereof are brought into registry with a plurality of threaded bores 38 formed in upper gear case 18. A cap screw 40 is disposed in each cap screw bore 36 and threaded into the respective threaded bore 38.

The second component of the gate driver 10 is the gear set 14. The gear set 14 has a drive shaft 42 that projects upward through the drive shaft bore 28 and is rotationally borne with the needle bearing 29. The drive shaft 42 is an elongate solid shaft preferably made of a steel material. Drive shaft 42 is preferably one-half inch in diameter and has flats 44 formed proximate the upper margin thereof. The flats 44 are designed to be grippingly engaged within the chuck 46 of battery powered hand drill 48. The drive shaft 42 is fixedly coupled to the helical input gear 50. The helical input gear 50 is supported within gear case 12 by the needle bearing 29 disposed within drive shaft bore 28 on the upper side and by a stub shaft 51 that is opposed to the drive shaft 42. The stub shaft 51 is borne within the needle bearing 29 that is disposed within the input gear bearing holder 23 formed in the lower gear case 20. The helical input gear 50 has a plurality of teeth 52 formed around the outer margin thereof.

A spur gear 54 is disposed next to the helical input gear 50. The teeth 56 formed on the outer margin of the spur gear 54 intermesh with the teeth 52 of the helical input gear 50. The spur gear 54 is rotatably held in place by an upper stub axle 57 and an opposed lower stub axle (not shown). The upper stub axle 57 is borne within the needle bearing 31 of the spur gear bearing holder 51. The lower stub axle is rotationally borne within a similar needle bearing 31 borne within a spur gear bearing holder 30 within the lower gear case 20, similar to the aforementioned spur gear bearing holder.

A helical output gear 58 comprises the third gear of the gear set 14. The helical output gear 58 is disposed adjacent to the spur gear 54 and the teeth 60 of the helical output gear 58 are intermeshed with the teeth 56 of the spur gear 54. The gear reduction effected from the helical input gear 50 and the spur gear 54 is approximately 5 to 1. The helical output gear 58 is fixedly borne on the gate chuck 16.

The gate chuck 16 is the third subcomponent of gate driver 10. The gate chuck 16 has an elongate cylindrical tube 62 that projects above and below the gear case 12. An axial gate bore 64 is formed in tube 62. The gate bore 64 is preferably one and three-eighths inches in diameter. The gate bore 64 is designed to loosely engage and support the gate shaft 82 of gate 80.

A replaceable bit 66 is disposed at the lower margin of the elongate tube 62. The replaceable bit 66 has an inside diameter that is slightly greater than the outside diameter of tube 62. The replaceable bit 66 is affixed to tube 62 by set screws 70. Alternatively, the replaceable bit 66 may be removably affixed to the tube 62 by cooperative threads formed in bit 66 and the tube 62.

A series of teeth 72 are formed in the lower margin of the replaceable bit 66. The notches 72 are designed specifically to mate with the driving teeth 88 of the specific make of gate 80 that is to be driven. The gates 80 by various manufacturers have driving teeth 88 that are unique to that particular make. Accordingly, a series of replaceable bits 66 is made available, each such bit having unique notches 72 designed to engage the driving teeth 88 of a different make of gate 80.

The gate 80 has an elongate gate shaft 82 that projects approximately four feet above the surface of the snow of the ski slope. Mounted on the lower end of the gate shaft 82 is the auger portion 84 of the gate 80. The auger portion 84 has a spiral flight 86 designed to be rotationally driven into the snow. At the upper margin of the auger portion 84 are a set of upwardly projecting driving teeth 88. The teeth 72 of the replaceable bit 66 an designed to engage the driving teeth 88.

The gate driver 10 is prepared for operation by engaging the chuck 46 of the battery powered hand drill 48 with the flats 44 of the drive shaft 42. This is done conventionally using a key that is supplied with the battery powered hand drill 48 in the same way that a drill bit is locked within the chuck 46. The appropriate replaceable bit 66 that is designed to be used with the specific make of gate 80 is affixed to elongate tube 62 by using the set screws 70 or by threading thereon.

In operation, the top of the gate shaft 82 of the gate 80 is slipped into the replaceable bit 66 and up through the gate bore 64 of the elongate tube 62 until the driving teeth 88 of the gate 80 engage the teeth 72 of the replaceable bit 66. The operator then grasps handle 32 with one hand and the battery powered hand drill 48 with the other hand. The gate 80 is positioned in an upright position. Downward force is exerted on the handle 32. The battery powered hand drill is actuated. Such action causes rotation of the gate 80, driving the spiral flight 86 into the snow.

Figure 5:
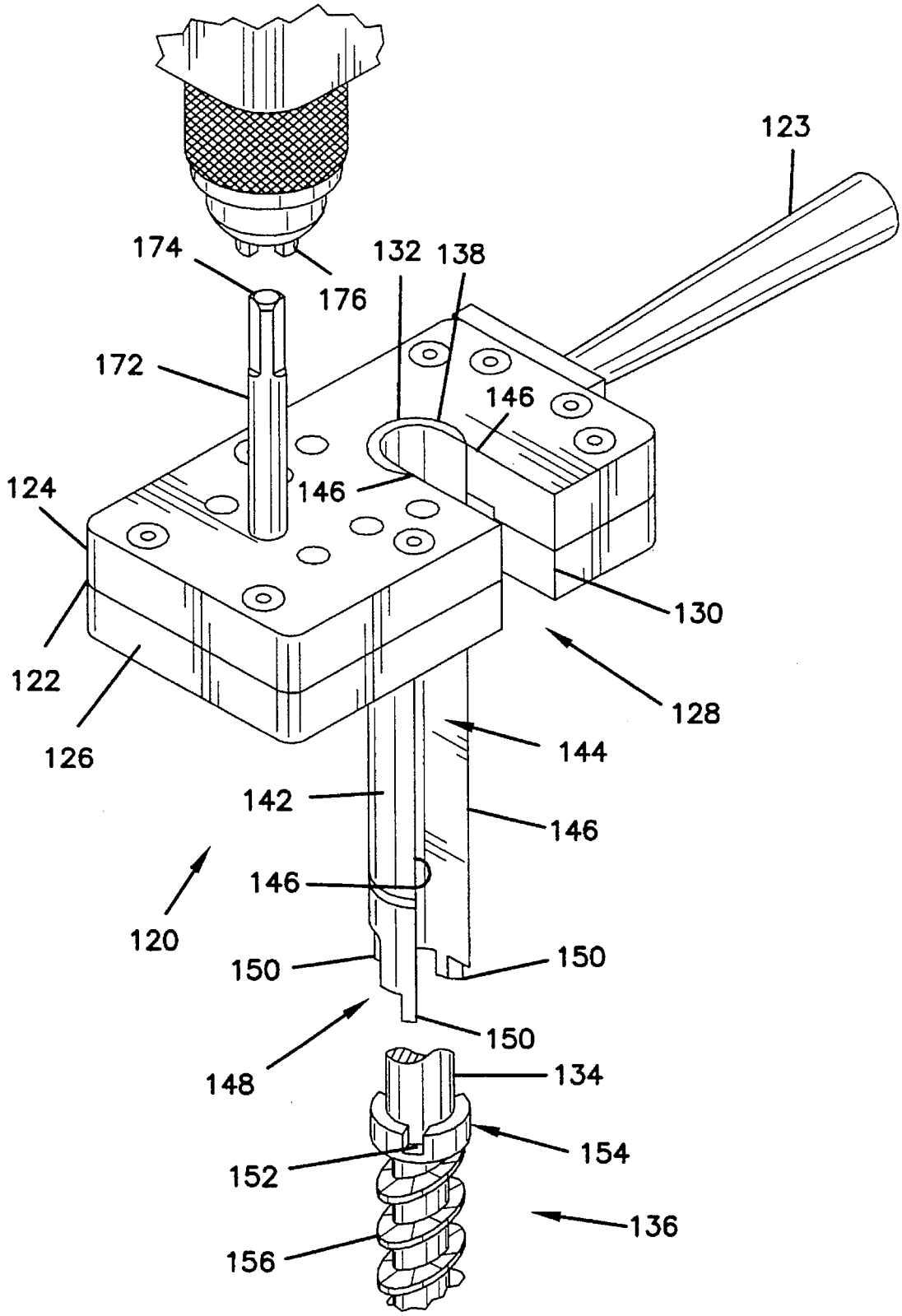
FIG. 5 is a perspective view of an alternative portable driving device constructed in accordance with the principles of the present invention.
Figure 6:
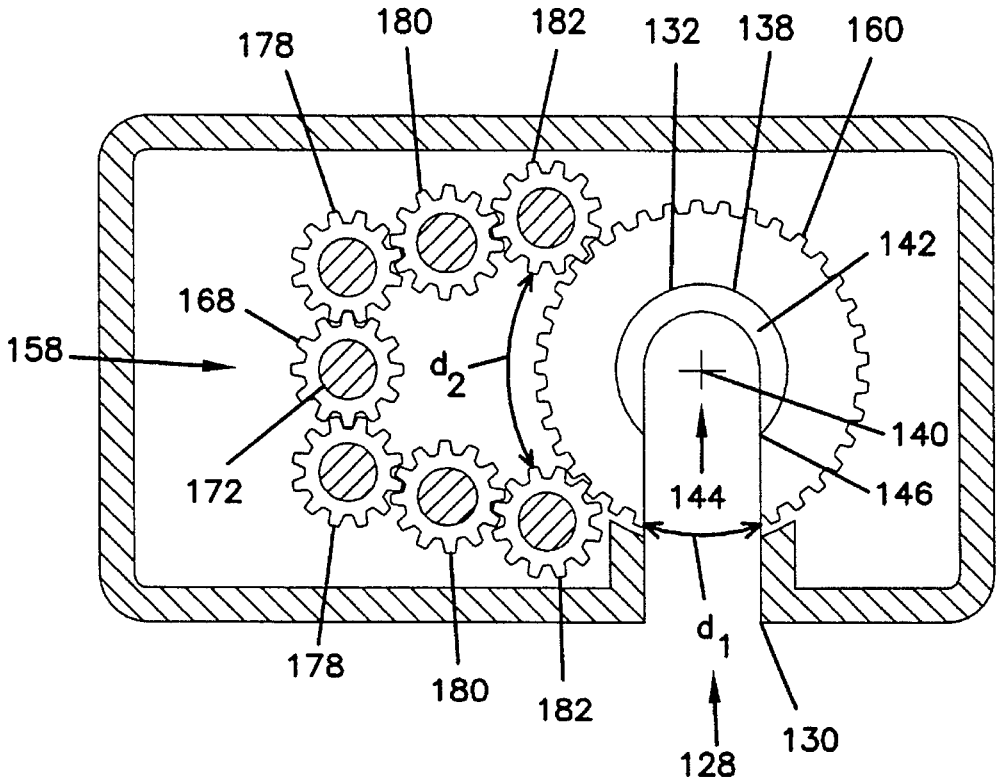
FIG. 6 is a cross-sectional view taken along section line 6—6 of FIG. 5 and illustrating an exemplary rotational transference assembly.
Figure 7:
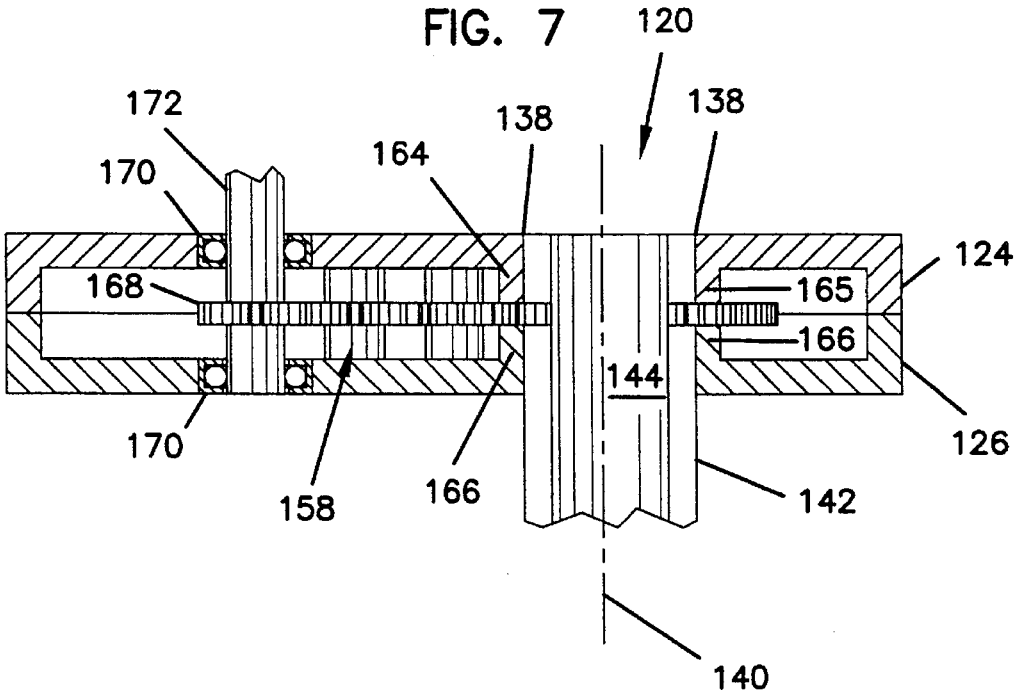
FIG. 7 is a cross-sectional view taken along section line 7—7 of FIG. 5.

FIGS. 5–7 show an exemplary alternative driving device 120 constructed in accordance with the principles of the present invention. The driving device 120 includes a housing 122 including an upper portion 124 and a lower portion 126 that are fastened together by conventional fastening techniques such as bolts. The housing 122 defines a slot 128 having an open end 130 opposite from a closed end 132. The open end 130 of the slot 128 is sized to receive a pole portion 134 of a ski course gate 136. The closed end 132 of the slot 128 is slightly enlarged and defines a generally cylindrical shaped bore 138 that is centered on a longitudinal axis 140 extending generally transversely through the housing 122. A handle 123 is preferably connected to the housing 122 for grasping the driving device 120.

A drive member such as an elongated, generally cylindrical drive shaft 142 or other type of drive member is rotatably mounted in the bore 138 at the closed end 132 of the slot 128. The shaft 142 is centered on the longitudinal axis 140 and defines an longitudinal channel 144 extending throughout the length of the shaft 142. The longitudinal channel 144 is sized and configured for receiving the pole portion 134 of the gate 136. Furthermore, the shaft 142 has an open side 146 extending longitudinally along the length of the shaft 142. The open side 146 has a width slightly larger than the diameter of the pole portion 134 of the gate 136. The width provided by the open side 146 of the shaft 142 allows the pole portion 134 of the gate 136 to be laterally inserted directly into the longitudinal channel 144. Such an open-sided configuration eliminates the awkward and time consuming step of axially sliding the shaft 142 over the top of the pole portion 134 of the gate 136.

A key 148 or other type of gate engaging structure adapted for transferring torque is preferably connected to the bottom of the drive shaft 142. The key 148 has teeth 150 adapted to mate with slots 152 of a keyway 154 defined by an auger portion 156 of the gate 136 so as to form a torque transferring engagement therewith. The key 148 provides a means for transferring torque from the rotatable drive shaft 142 to the gate 136 and is preferably detachably connected to the bottom of the drive shaft 142 by conventional connection techniques. For example, the connection can be made by set screws or the key 148 can be threaded on the drive shaft 142. Because the key 148 is detachable, gate engaging structures of various sizes and configurations can be used depending upon the particular make of course gate desired to be driven.

The driving device 120 includes a rotational transfer assembly, such as a gear assembly 158, that is adapted for transferring rotation. The gear assembly 158 is mounted in the housing 122 and includes an output gear 160 fixedly connected to the drive shaft 142. The output gear 160 extends radially outward from the drive shaft 142 and is generally transversely aligned with respect to the longitudinal axis 140. The output gear 160 has drive teeth that define a periphery of the output gear 160. The periphery of the output gear 160 is generally centered on the longitudinal axis 140. The output gear 160 also has a radial gap that is aligned with and corresponds to the open side 146 of the drive shaft 142. The radial gap has a radial distance designated by $d_1$.

The output gear 160 is rotatably mounted in the housing 122 by a bearing structure. For example, the driver device 120 is shown including a bearing structure formed by opposing upper and lower shoulders 164 and 166 respectively integrally formed with the upper and lower portions 124 and 126 of the housing 122. When the driving device 120 is assembled, the upper and lower shoulders 164 and 166 encircle a substantial portion of the drive shaft 142 and the output gear 160 is retained between the shoulders 164 and 166. It will be appreciated that by fabricating the housing 122 of a petroleum based plastic, the bearing structure will be self-lubricating thereby reducing bearing friction.

The gear assembly 158 also includes an input gear 168 rotatably mounted in the housing 122 by conventional means such as bearings 170 mounted in the upper and lower portions 124 and 126 of the housing 122. The input gear 168 is adapted for being rotationally coupled to a rotational power source. For example, the input gear 168 is shown fixedly connected to an input shaft 172 mounted in the bearings 170 and having a distal end 174 extending transversely outward from the top of the upper portion 124 of the housing 122. The distal end 174 functions as a bit and is adapted to be rotationally coupled to a rotational power source such as a chuck 176 of an electric drill.

A rotational input generated by the rotational power source is transferred from the input gear 168 to the output gear 160 by first, second, and third pairs of spaced apart gears 178, 180 and 182. The first, second and third pairs of gears 178, 180 and 182 are rotationally mounted in the housing 122 by conventional means such as bearings. The gears of the first pair 178 are aligned on opposite sides of the input gear 168 and rotationally interlock with the input gear 168. The second gear pair 180 rotationally interlocks with the first gear pair 178. The third gear pair 182 rotationally interlocks with the second gear pair 180. The output gear 160 rotationally interlocks with the third gear pair 182.

The component gears of the first, second and third pairs of gears 178, 180 and 182 are progressively spaced farther apart. For example, the gears of the second gear pair 180 are spaced farther apart than the gears of the first gear pair 178. Similarly, the gears of the third gear pair 182 are spaced farther apart than the gears of the second gear pair 180. The spacing between the gear pairs 178, 180 and 182 is progressively increased to provide a radial spacing distance $d_2$ between the third pair of gears 182 that is at least equal to the radial distance $d_1$ of the radial gap in the output gear 160. Consequently, always at least one of the gears of the third pair 182 is interlocked with the output gear 160 despite the radial gap in the periphery of the output gear 160.

As shown in FIGS. 5–7, the gears 160, 168, 178, 180 and 182 of the gear assembly 158 are spur gears that are rotatable about parallel axes and are aligned generally along a single plane. However, rotational transference assemblies other than the gear assembly specifically shown can be used to transfer rotation from a rotational power source to a drive member. For example, the relative size, type, number, and arrangement of the gears employed to transfer rotation can be varied. Also, other types of implements for transferring rotation such as pulleys, belts, chains and friction gears can be substituted for gears and arranged to transfer rotation from a rotational input to a drive member.

As previously described, a preferred use for the driving device 120 is to drive a ski course gate 136 in a snow covered surface. In use, the key 148 is first connected to the bottom of the drive shaft 142 and the electric drill chuck 176 is rotationally coupled to the distal end 174 of the input shaft 172. The open side 146 of the drive shaft 142 is then moved into alignment with the open end 130 of the housing slot 128 such that the slot 128 is unobstructed. The open side 146 of the drive shaft 142 and the open end 130 of the housing slot 128 are aligned by activating the electric drill causing the gear assembly 158 to rotate the drive shaft 142 within the slot 128.

When alignment is achieved, the electric drill is deactivated and the pole portion 134 of the gate 136 is inserted laterally through the slot 128 and into the longitudinal channel 144 of the drive shaft 142. The drive shaft 142 is then slid axially downward along the pole portion 134 and the teeth 150 of the key 148 are interlocked within the slots 152 of the auger keyway 154. Next, the electric drill is re-activated causing torque to be transferred through the driving device 120 to the auger portion 156 of the gate 136 causing the gate 136 to axially rotate. As the gate rotates, a downward force is exerted on the handle 123 of the driving device 120 causing the auger to drill into the snow covered surface thereby anchoring the gate 136.

Although the preferred use of the above-described invention is to drive ski-course gates, it will be appreciated that the invention can also be used to transfer torque to other types of members or structures.

While the preferred embodiment of the present invention has been illustrated and described herein, it is to be understood that the invention is not limited to the precise construction so illustrated and described herein. Accordingly, it is intended that the scope of the present invention be dictated by the scope of the appended claims and not the description of the preferred embodiment.

I claim:

1. A system for setting up a ski course comprising:

a plurality of ski course gates each having a pole portion and an auger portion; and a portable driving device for rotationally driving the ski course gates into a snow covered surface, the portable driving device including:

a drive member rotatable about a longitudinal axis, the drive member defining a longitudinal channel configured to receive the portion of each ski course gate;

a gate engaging structure connected to the drive member and being constructed and arranged to form a torque transferring engagement with the auger portion of the gate; and a rotational transference assembly operably connected to the drive member and adapted to be rotationally coupled to a rotational power source, the rotational transference assembly being constructed and arranged to transfer a rotational input from the power source to the drive member causing the drive member to rotate about the longitudinal axis.

2. The system of claim 1, wherein the auger portion of each ski course gate defines at least two circumferentially spaced slots, and the gate engaging structure includes at least two circumferentially spaced teeth constructed and arranged to fit within the slots of each auger portion.

3. The system of claim 1, wherein the drive member includes an open longitudinal side adapted for receiving the pole portion of each gate into the longitudinal channel.

4. The system of claim 3, wherein the rotational transference assembly comprises a gear assembly.

5. The system of claim 4, wherein the gear assembly includes first and second spaced apart gears arranged such that always at least one of the first and second gears is in rotational engagement with a third gear, the third gear being fixedly connected to the drive member and having a gap that corresponds with the open side of the drive member, the first, second and third gears cooperating to rotate the drive member about the longitudinal axis.

6. The system of claim 5, wherein the gap of the third gear has a width equal to a first distance, the first and second gears are spaced a second distance apart, and the second distance is at least equal to the first distance.

7. A method for driving a ski course gate into a snow covered surface, the ski course gate having a pole portion and an auger portion, the method comprising the steps of:

(a) providing a portable driving device comprising:

a housing;

a drive member connected to the housing and rotatable about a longitudinal axis, the drive member defining a longitudinal channel configured to receive the pole portion of the ski course gate;

a gate engaging structure connected to the drive member and arranged and configured to form a torque transferring engagement with the auger portion of the gate;

a rotational power source; and a rotational transference assembly mounted within the housing for transferring a rotational input from the rotational power source to the drive member such that the drive member is caused to rotate about the longitudinal axis;

(b) inserting the pole portion of the ski course gate within the longitudinal channel of the drive member;

(c) sliding the pole portion longitudinally through the longitudinal channel of the drive member;

(d) forming a torque transmitting engagement between the gate engaging structure of the portable driving device and the auger portion of the ski course gate; and (e) activating the rotational power source while concurrently transferring a downward force to the ski course gate such that the portable driving device rotationally drives the auger portion of the ski course gate into the snow covered surface.

8. The method of claim 7 wherein the drive member defines an open side extending lengthwise along the drive member, and the pole portion of the ski course gate is inserted into the longitudinal channel of the drive member by moving the pole portion laterally through the open side of the drive member.

9. The method of claim 7, wherein the gate engaging structure includes at least two circumferentially spaced teeth, and the torque transmitting engagement between the gate engaging structure and the auger portion of the ski course gate is formed by inserting the teeth within circumferentially spaced slots defined by the auger portion.

* * * * *